United States Patent [19]

Thilo et al.

[11] 4,161,727

[45] Jul. 17, 1979

[54] PROCESS FOR GENERATING AND TRANSMITTING DIFFERENT ANALOG MEASURED VALUES TO A CENTRAL CONTROL FROM A PLURALITY OF FIRE ALARM CIRCUITS WHICH ARE ARRANGED IN THE FORM OF A CHAIN IN AN ALARM LOOP

[75] Inventors: Peer Thilo; Otto W. Moser, both of Munich, Fed. Rep. of Germany

[73] Assignee: Siemens Aktiengesellschaft, Berlin & Munich, Fed. Rep. of Germany

[21] Appl. No.: 821,840

[22] Filed: Aug. 4, 1977

[30] Foreign Application Priority Data

Sep. 15, 1976 [DE] Fed. Rep. of Germany ..... 2641489

[51] Int. Cl.[2] ..... G08B 23/00

[52] U.S. Cl. ..... 340/518; 340/584; 340/628

[58] Field of Search ..... 340/408, 227 R, 237 S, 340/505, 518, 584, 628

[56] References Cited

U.S. PATENT DOCUMENTS

| | | | |
|---|---|---|---|
| 3,214,734 | 10/1965 | Whitehead | 340/408 |
| 3,482,243 | 12/1969 | Buchsbaum | 340/408 |
| 3,676,877 | 7/1972 | Kobayashi | 340/227 R |
| 3,753,258 | 8/1973 | Honda | 340/408 |
| 3,797,008 | 3/1974 | Yuasa | 340/227 R |
| 3,832,678 | 8/1974 | Gysell et al. | 340/227 R |
| 3,932,858 | 1/1976 | Smith et al. | 340/408 |

*Primary Examiner*—Glen R. Swann, III

*Attorney, Agent, or Firm*—Hill, Van Santen, Steadman, Chiara & Simpson

[57] ABSTRACT

A fire alarm system has a central control connected to an alarm loop composed of a plurality of fire alarm circuits. Prior to an interrogation of the alarm circuits, the same are disconnected from a supply voltage and supplied by respective capacitors which are charged during connection of a full supply voltage. The individual alarms are subsequently reconnected in the alarm loop in a given sequence by a new voltage change, at a reduced voltage, and each alarm circuit is operable to connect the following alarm circuit to the loop and thus to the line voltage at a time delay corresponding to a measured value of a fire characteristic being monitored by that alarm circuit. In a central analysis device, the relevant alarm circuit address can be derived from the number of preceding increases in line current, and the associated measured value can be derived from the length of the switching delay of the corresponding alarm circuit. Different sequences of applying line voltage may be used such that three line voltage states of "rest interval—interrogation—capacitor charge" and "rest interval—capacitor charge—interrogation" and also the different durations of these states in that the line voltage state "rest interval" is approximately one hundred times greater than is common to the other line states.

6 Claims, 11 Drawing Figures

O0
O3
O2
O0
500msec
300msec
10sec

NO1'
NO2'
NO3'
NO0'
N'

N
NO3
NO2
NO0
Ze
Sy
st
Us
Re1
Re2
Wi1
Wi3
Wi2
Ue
Ue
Ke
Ke
Ba2
Ba1
INVERTER
D.C.
+

PROCESS FOR GENERATING AND TRANSMITTING DIFFERENT ANALOG MEASURED VALUES TO A CENTRAL CONTROL FROM A PLURALITY OF FIRE ALARM CIRCUITS WHICH ARE ARRANGED IN THE FORM OF A CHAIN IN AN ALARM LOOP

CROSS REFERENCE TO RELATED APPLICATIONS

This application is related to an application of Moser et al, Ser. No. 821,839, filed Aug. 4, 1977 and also to an application of Thilo et al, Ser. No. 821,837, filed Aug. 4, 1977, both assigned to the same assignee as the present invention.

BACKGROUND OF THE INVENTION

1. Field of the Invention

This invention relates to fire alarm systems, and is more particularly concerned with a process for generating and transmitting different analog values to a central control from a plurality of fire alarm circuits which are connected in a chain fashion in an alarm loop.

2. Description of the Prior Art

It is well known in the art to transmit different analog measured values to a central control from a plurality of fire alarm circuits which are arranged in the form of a chain in an alarm loop, hereinafter called the alarm line, and which prior to interrogation are disconnected from the alarm line by a voltage change and are then supplied with current by individual respective capacitors which can be charged during connection of the full line voltage. The individual alarms can be subsequently reconnected to the alarm line in a given sequence by a new voltage change (at a reduced line voltage). Each preceding line circuit connects the following alarm circuit to the line voltage with a time delay representing the measured value of the fire characteristic and in a central analysis device the relevant alarm circuit address can be determined from the number of preceding increases in line current and the associated measured value can be derived from the length of the switch delay of the corresponding alarm circuit.

In the event of a breakdown in the commercial power supply, firm alarm systems are to be supplied by a second, independent energy source for a minimum length of time. Generally speaking, batteries serve as such a second, independent source. The requisite capacity of this emergency current supply is determined, on the one hand, by the current drain of the alarm central control and, on the other hand, by the number of alarm circuits connected to the central control. As mentioned above with respect to the prior art, through chain synchronization, the analog measured values and the alarm circuit addresses can be transmitted in a simple fashion to the central control for appropriate analysis. Capacitors in the alarm circuits are charged following the interrogation with normal line voltage and, in this manner, in the periods of time in which no voltage is connected to the line, the capacitors are able to feed the alarm circuits and thus bridge these breakdown times.

SUMMARY OF THE INVENTION

The object of the present invention is to greatly reduce the energy consumption of the individual alarm lines, without thereby jeopardizing the reliability of the transmission from the alarms to the central control, and notwithstanding the requirement of a low energy consumption, the system is to operate without interference.

According to the invention, the foregoing objects are achieved, by the differing sequence of the three line voltage states "rest interval—interrogation—capacitor charge" and "rest interval—capacitor charge—interrogation", and also from their different durations of time, i.e., the line voltage rest state interval is approximately one hundred times greater than is common for the line states "interrogation—capacitor charge" and "capacitor charge—interrogation". By appropriately selecting the capacitance of the individual storage capacitors in the alarm circuits, the latter are able to accommodate sufficient energy to allow the alarm circuits to remain unconnected to the line voltage for a longer period of time without impairing their functional capability, as the ionization type fire alarms require virtually no power and the other components, such as transistors, can be disconnected in the rest state. In this manner it is possible to considerably limit the energy consumption of such an alarm line, without thereby jeopardizing the alarm transmission.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
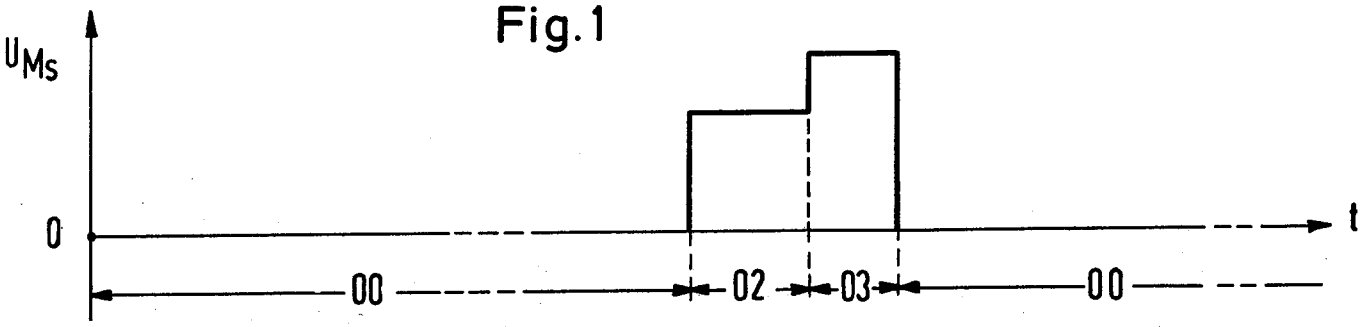
FIGS. 1 and 2 are respective interrogation diagrams having long intervals and differing sequences for the three possible line voltage states.

Referring first to FIG. 1, a voltage curve is illustrated for an alarm line in which there is, in sequence, a rest interval 00 (no line voltage), followed by an interrogation 02 (low line voltage), in turn followed by a capacitor charge interval 03 of the capacitors Co1 (FIG. 3), etc (full line voltage) for the alarm circuits.

Figure 2:
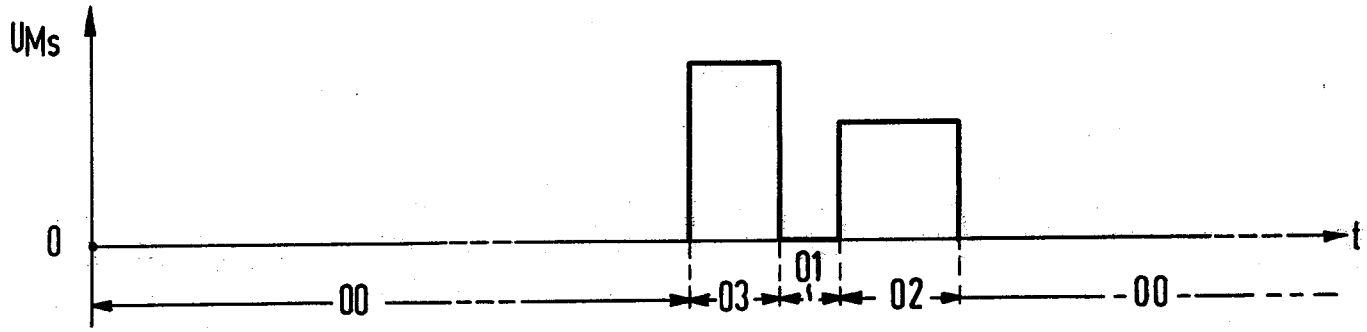

In FIG. 2, the rest interval 00 (no line voltage) is followed by the charge intervals 03 for the capacitors Co1, etc (full line voltage), thereafter followed by a start interval 01 for initating interrogation (again no line voltage), and finally by the interrogation interval 02 (low line voltage).

These sequences and the resulting responses will be readily apparent from the following description.

Figure 3:
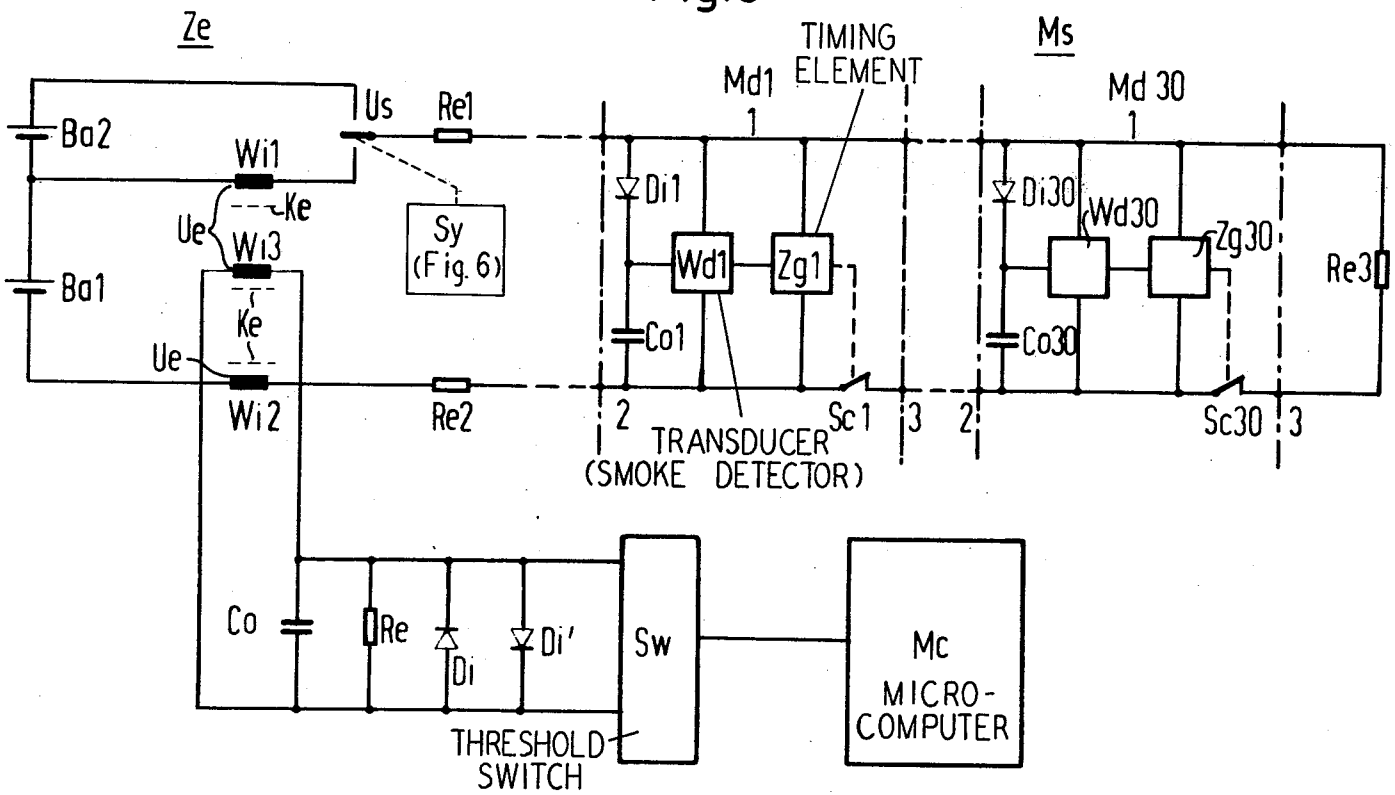
FIG. 3 is a schematic representation of a fire alarm system having a plurality of alarm circuits and a central control.
Figure 4:
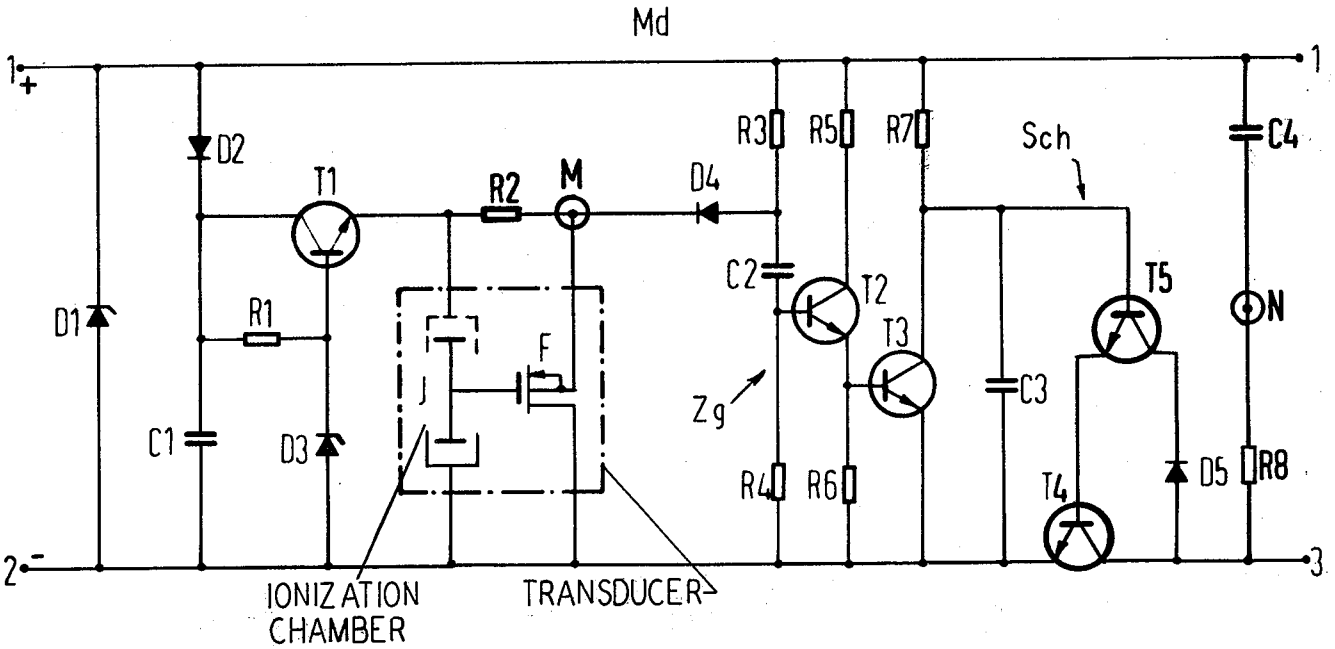
FIG. 4 is a schematic circuit diagram of an alarm circuit for use in the system of FIG. 3.
Figure 9:
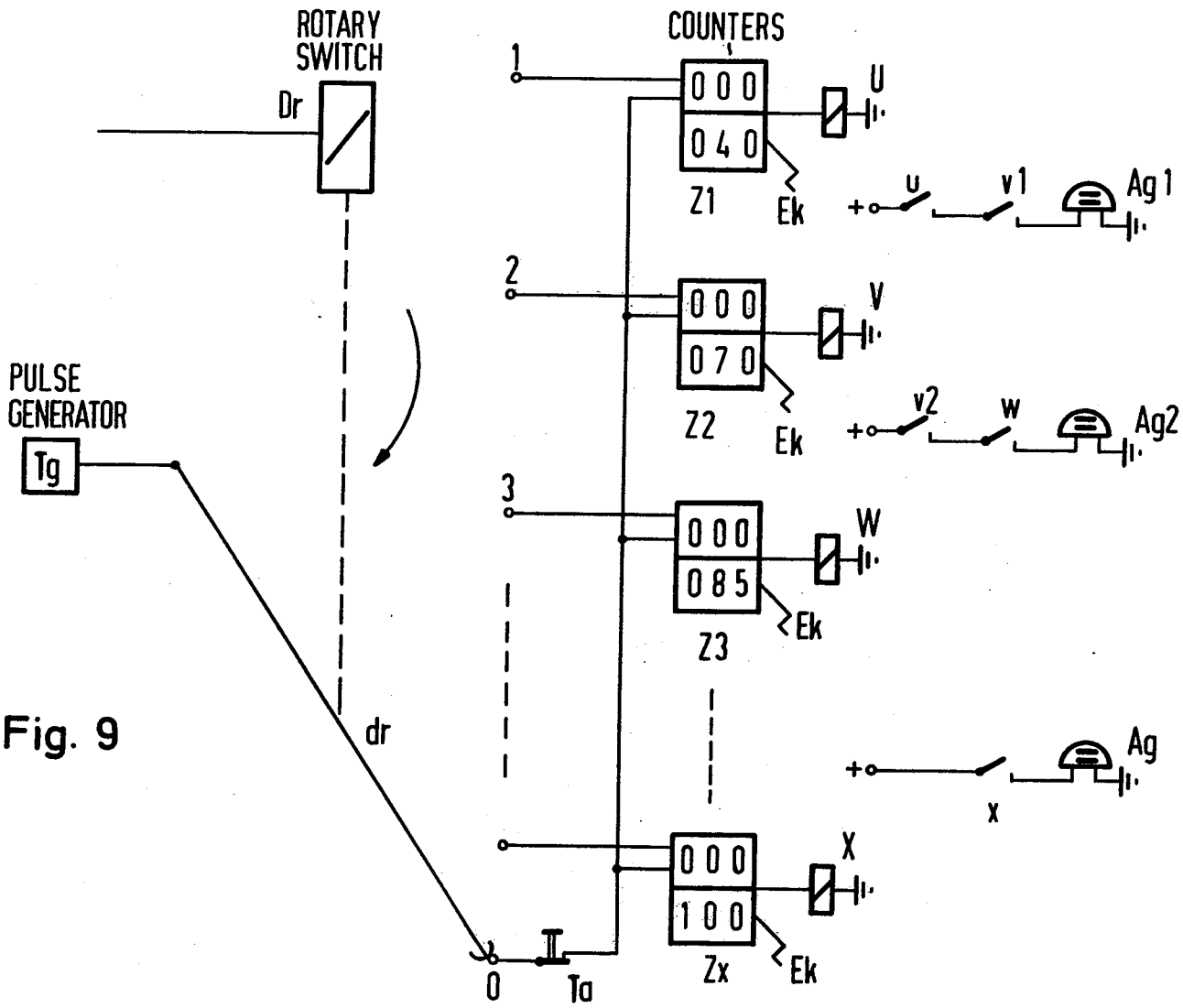
FIG. 9 is a simplified schematic illustration of a microcomputer for analyzing the information read from the alarm circuits during interrogation.

In the first alarm system illustrated in FIG. 3, a plurality of alarm circuits Md1–Md30 and an analysis device Mc have been schematically illustrated, these circuits being illustrated in greater detail in FIGS. 4 and 9, respectively. A central control Ze includes a pair of serially-connected batteries Ba1, Ba2 (full line voltage) which can be connected to the alarm line Ms composed of the alarm circuits Md1–Md30 by way of a transfer switch Us. Also, by way of the transfer switch Us the alarm line Ms can be connected to the battery Ba1 alone (low line voltage). A transformer Ue includes a pair of interrogation windings Wi1, Wi2 which are symmetrically looped into the supply lines of the battery Ba1 and feed pulses occurring therein, via a common transformer core Ke, to an output winding Wi3 of the transformer. The transformer is tuned to a particular resonant frequency by way of a capacitor Co and is strongly damped by a resistor Re. The measuring signals emitted by the alarm circuits Md1–Md30 by way of the transformer Ue pass across a pair of oppositely connected limiting diodes Di, Di' and by way of a threshold value switch Sw and are converted by these elements into rectangular pulses which are fed to a micro-computer Mc. In the micro-computer Mc, the rectangular signals are individually analyzed, as described below in connection with FIG. 9.

When the alarm line Ms is ready for operation, in accordance with FIG. 1, following the last interrogation 02, the individual capacitors Co1–Co30 are to have been charged during the charging interval 03; the alarm line Ms is thus ready for interrogation. For the next interrogation, the transfer switch Us must then be operated (downwardly as illustrated in FIG. 3) to connect the low line voltage of the battery Ba1 (interrogation 02). Voltage is now connected to the alarm line Ms by way of a pair of attenuating resistors Re1, Re2. Thereafter, the transfer switch Us must be operated upwardly, as a result of which the capacitors Co1–Co30 which had in the meantime assumed the energy supply of the alarm line Ms and had been partially discharged, are charged again by the full line voltage of the batteries Ba1 and Ba2 (charging interval 03). For the rest interval 00, the transfer switch Us must finally be brought into the rest position illustrated in FIG. 3 (no line voltage, rest interval 00).

In the absence of voltage across the alarm line Ms, the timing elements Zg1–Zg30 open all of the interrogation switches Sc1–Sc30 in the individual alarm circuits Md1–Md30, and thus disconnect the alarm circuits from the central control Ze. If voltage now is applied to the alarm circuit Md1, in accordance with the fire characteristic value the measuring transducer Wd1 operates the associated time element Zg1 which, after a predetermined length of time, closes the associated interrogation switch Sc1 and thus connects the alarm circuit Md2 to the central control Ze. In this manner, all of the alarm circuits Md1–Md30 are connected to the central control Ze consecutively and in the form of a chain at different times. Here, the individual alarm circuits Md1–Md30 are characterized by the sequence of their reconnection to the central control Ze, and the fire characteristic values established by the transducers are characterized by the time differences $t_1$–$t_{30}$ (FIG. 5) between the operation of the individual alarm circuits. The series arrangement of a diode Di1–Di30 and a capacitor Co1–Co30 in the individual alarm circuits here simply has the function of supplying voltage to the measuring transducers Wd1–Wd30, and possibly also the timing elements Zg1–Zg30 for the time during which the voltage is disconnected from the central control Ze.

FIG. 4 is a detailed illustration of an alarm circuit Md. A Zener diode D1 serves only as a protection from excess voltages, and when the alarm Md is connected to the incorrect polarity the diode is to protect the individual components of the alarm circuit, in particular the transistors T1–T5. A diode D2 allows a capacitor C1 to be charged for such time as the high voltage of the two batteries Ba1 and Ba2 is connected to the alarm line Ms in the charging interval 03. On the other hand, the diode D2 prevents a discharge of the capacitor C1 when the alarm line Ms is disconnected from the central control Ce in the intervals 00 and 01, and is supplied by the battery Ba1 in the interval 02. However, the capacitor C1 itself supplies the requisite operating voltage for the alarm circuit Md, and this bridges the no voltage intervals (intervals 00, 01). In association with a resistor R1 and a Zener diode D3, a transistor T1 serves to produce a voltage stabilization for an ionization chamber J. In association with a load resistor R2, a field effect transistor F amplifies the output voltage of the ionization chamber J. Thus, the voltage across a measuring point M changes in dependence upon the particular fire parameter measured by the transducer, here the smoke concentration in the ionization chamber J.

The timing element ZG illustrated in FIG. 3 is illustrated in greater detail in FIG. 4 as comprising a plurality of resistors R3–R6, a capacitor C2 and a pair of transistors T2 and T3. The transistors T2 and T3 are conductive for such time as the capacitor C2 is charged. Following the disconnection of the voltage from the central control Ze, it has in fact discharged (the diode D4 blocks the voltage at the measuring point M), and is now recharged to the voltage appearing at the measuring point M. During this period of time, a pair of interrogation transistors T4 and T5 are in a blocking condition. When the voltage across the capacitor C2 has finally reached the value predetermined by the potential at the measuring point M, the transistors T2 and T3 are rendered non-conductive and, in turn, render the transistors T4 and T5 conductive, as a result of which they connect the next alarm circuit to the alarm line Ms. A resistor R7 here determines the base current for the transistor T5 and a capacitor C3 prevents a temporary switch-through of the transistor T4 as a result of transients when the voltage is connected between the points 1 and 2. Finally, a diode D5 serves merely to bring about an improved actuation of the transistor T4, but does not constitute the subject matter of the present invention, although the same is an important feature of the aforementioned Moser et al application. When the next alarm circuit Md is connected to the alarm line Ms, the series arrangement of a resistor R8 and a capacitor C4 is also connected in parallel to the loop so that the capacitor C4 becomes charged again; on the last occasion on which the voltage was disconnected, the capacitor C4 had in fact discharged by way of the alarm line Ms.

Figure 5:
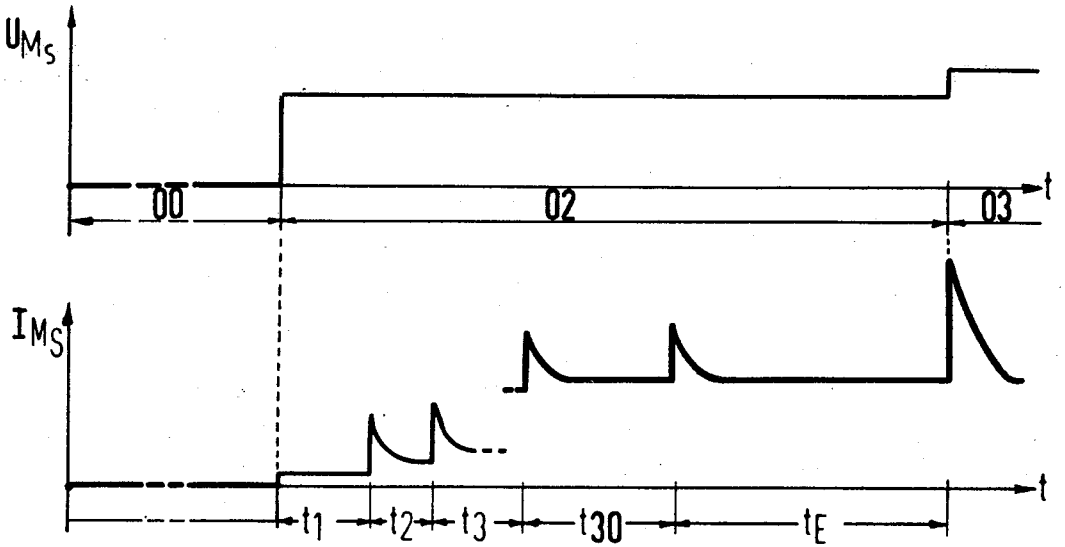
FIG. 5 is an interrogation diagram relating alarm line voltage and the resultant line current.

The charging current of the capacitor C4 produces switch-on current peaks in the current diagram $I_M$ in the lower portion of FIG. 5 at the beginning of the times $t_2$, $t_3$. . . etc and thus clearly characterizes the switching on of the particular next alarm circuit Md.

The control and generation of the commands for the aforementioned line states, and the reading of information from the alarm line will be explained below with reference to FIGS. 6–9.

Figures 6, 6A, 6B:
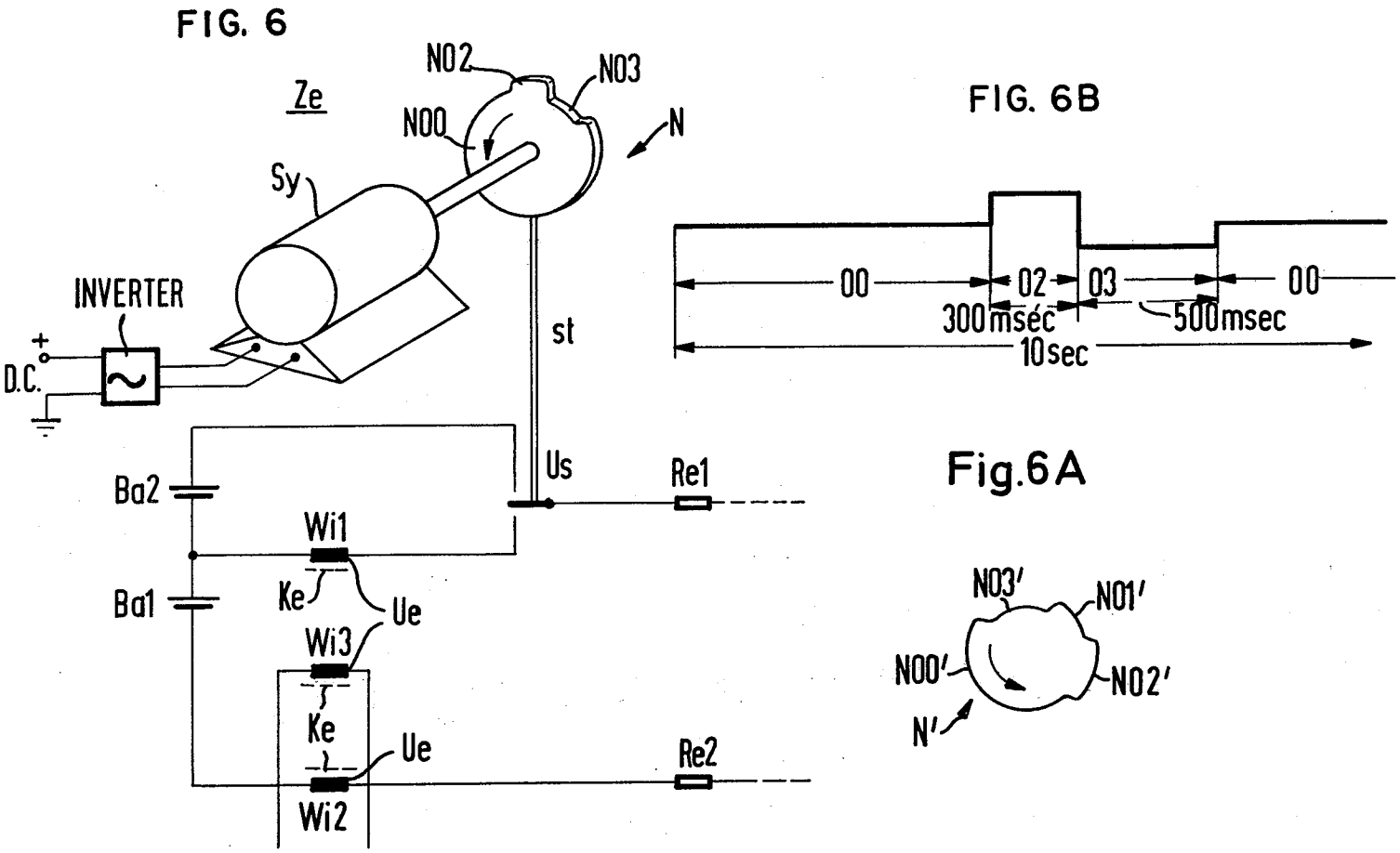
FIG. 6 is a schematic diagram of apparatus which may be employed to establish and control the alarm line states and to thereby produce the interrogation diagram of FIG. 1.
FIG. 6A is a schematic illustration of a cam structure for producing the voltage curve illustrated in FIG. 2.
FIG. 6B is a camming diagram as an aid in understanding the operation of the circuit of FIG. 6.

Referring first to FIG. 6, the transfer switch Us is illustrated as being mechanically linked to a synchronous motor Sy (schematically illustrated in FIG. 3), by way of a rod St which engages a cam N. The cam N has been provided with a peripheral structure including a portion N00 corresponding to the interval 00, a portion N02, corresponding to the interrogation interval 02, and a portion N03, corresponding to the charging interval 03. With the movable contact of the transfer switch Us in the position shown, the contact remains in that position as the synchronous motor Sy rotates the cam N, in the direction indicated by the arrow, as the rod St rides along the cam portion N00. Upon engagement of the portion N02, the rod St depresses the movable contact so as to connect the alarm line to the battery Ba1, as indicated in FIG. 1 and in the camming diagram of FIG. 6. After an interval determined by the speed of rotation and the peripheral length of the portion N02 (interrogation interval 02), the rod St engages the portion N03 so that the movable contact is transferred away from connection with the battery Ba1 and into connection with the battery Ba2 in series with the battery Ba1 to establish the charging interval 03. Subsequently, the cam N is rotated so that the rod St again engages the portion N00. It will be appreciated that the line voltage curve of the upper portion of FIG. 5 is the same as FIG. 1, but on an expanded time scale so that the current responses of the alarm circuits are more readily apparent.

Figure 7:
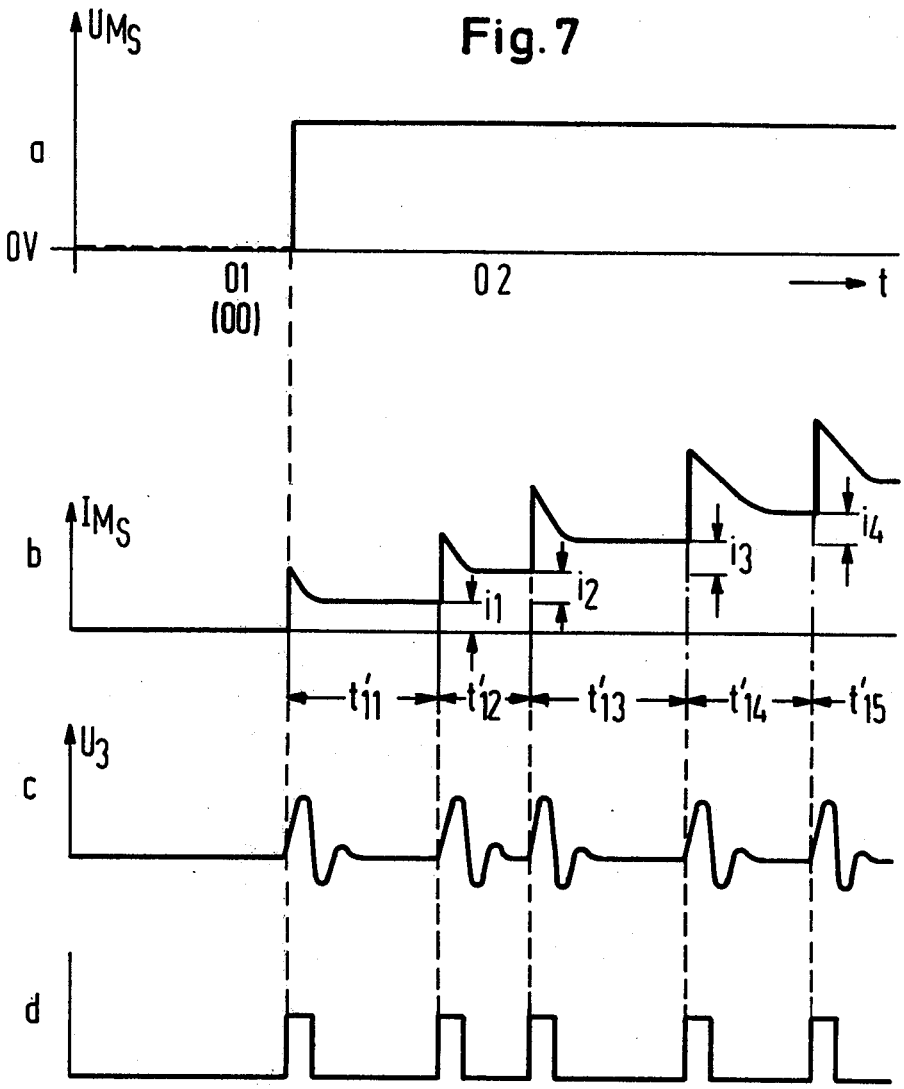
FIG. 7 is a diagrammatic illustration similar to FIG. 5 illustrating current and voltage states on the alarm line and the resultant signals read by the central control.

Referring to FIG. 7, which is primarily an expanded version of the information in FIGS. 1 and 5, particularly with respect to signal transmission from the alarm circuits to the central control, the relationship between the applied voltage and the step-wise response of the alarm circuits is illustrated. In the curve a, the line voltage is disconnected and then reconnected providing the intervals 00 and 02, respectively. In the curve b it is illustrated that following the reconnection of the lower voltage to the alarm line Ms for interrogation, an approximately stepped current $I_M$ flows representing the sequential connection of the alarm circuits extending a loop from the central station toward the loop termination, represented by the resistor Re3 in FIG. 3. The magnitude of the individual current steps $i_1$, $i_2$, etc is constant since the current drain per alarm circuit Md is virtually independent of the parameter being measured. The duration of the individual steps $t'_{11}$, $t'_{12}$, etc is the measure of the respective value transmitted by the alarm circuits. The index line has been selected in order to illustrate that the individual values $t'_{11}$, etc are not directly associated with the preceding figures. As the signals from the alarm circuits are connected in the sequence of their arrangement along the alarm line Ms, each individual signal can be identified by including the previous current steps as is readily apparent to those skilled in the art from FIG. 7 and FIG. 9 to be discussed below.

Figure 8:
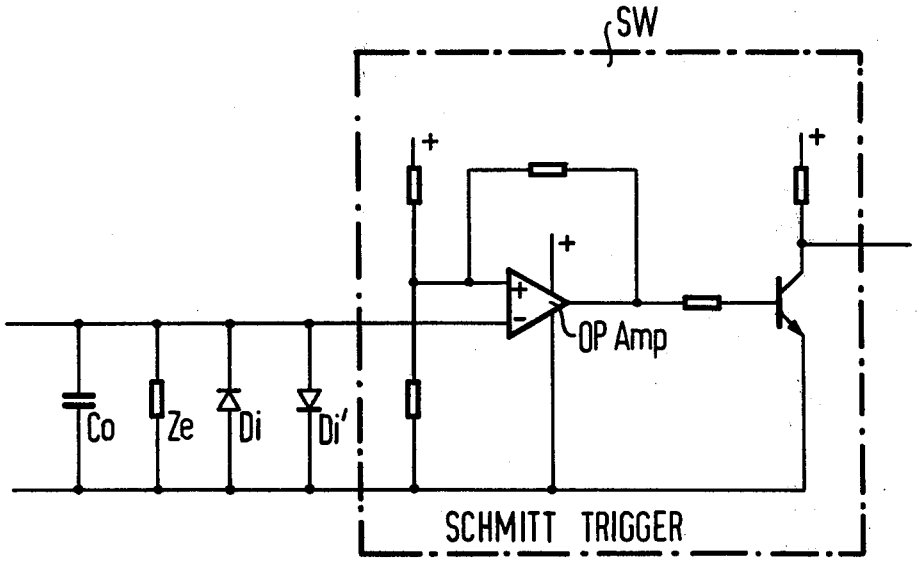
FIG. 8 is a schematic circuit diagram of a Schmitt trigger circuit which may be employed as the threshold switch of the central control illustrated in block form in FIG. 3.

As the primary windings Wi1, Wi2 of the transformer Ue are schematically arranged in the forward and return paths of the alarm line, each current alteration effects a voltage pulse in the primary windings which is transferred to the secondary winding Wi3. At the secondary side, the transformer Ue is tuned to a particular resonant frequency by a capacitor Co and is strongly damped by the resistor Re, as mentioned above. The output signal illustrated in curve c of FIG. 7 is therefore obtained and fed to a converter which comprises the limiting diode Di and Di' and the threshold value switch Sw. The threshold value switch can be a Schmitt trigger, as illustrated in FIG. 8 and can be constructed in accordance with the article entitled "Comparator Circuit Makes Versatile Schmitt Trigger", by Phil Scherrod, published in the periodical "Electronics", Feb. 19, 1976 at p. 128 et seq, and may utilize, for example, the components described in the National Semiconductor Data Sheet entitled "Operational Amplifiers", and identified as LM741/LM741C operational amplifier circuits. The diodes and threshold switch convert the damped oscillations of the curve c of FIG. 7 to the rectangular pulses of the curve d of FIG. 7 and feed the same to the microcomputer Mc, as illustrated in FIG. 3, and as discussed hereinbelow with reference to FIG. 9.

Referring to FIG. 9, a functional illustration of the microcomputer Mc is provided which includes a rotary switch Dr having a selector contact dr which is stepped through a plurality of contact positions to connect a pulse generator Tg sequentially to a plurality of counters Z1–Zx. Each of the counters has an associated comparator circuit which can be set, by way of an associated dial Ek, to a desired number of pulse counts. On the drawing, the counter Z1 has been set to 40 pulses, the counter Z2 has been set to 70 pulses, the counter Z3 has been set to 85 pulses and the counter Zx has been set to 100 pulses. Each of the counters has a respective relay U–X connected thereto and operated thereby, the relays having associated contact u–x. The contacts u–x are serially interposed in the powering circuits of alarm generators Ag1–Ag3.

The pulse generator Tg provides pulses of, for example, 50 μs to the counters Z1–Zx when interconnected therewith. As indicated above, the pulse generator Tg is sequentially connected to the counters in response to each pulse received by the excitation winding Dr of the rotary switch.

Assuming the comparators to be set as described above and as illustrated on the drawing, and assuming a first pulse from the curve d of FIG. 7 has caused the contact arm dr to connect the pulse generator Tg with the counter Z1, the counter Z1 is pulsed during the interval $T'_{11}$, that is until such time as the second pulse of the curve d causes the selector contact dr to be moved to connect the pulse generator with the counter Z2. During the interval $t'_{11}$, the counter Z1 is pulsed by the pulses of the pulse generator Tg. If the predetermined count of the comparator (here 40 pulses) is reached, the comparator causes the relay U to operate and close its contact u. This prepares the alarm generator Ag1 for operation in that there is an interposed contact v1 of the relay V. It is apparent, however, that this part of the alarm circuit could take the form as shown below with respect to the alarm generator Ag3 so that an alarm would be given immediately, without waiting for confirmation by the next alarm circuit. If the relay V is operated upon a pulse count of 70 by the counter Z2, the contact v1 is closed to energize the alarm generator Ag1 and the contact v2 is closed to prepare the alarm generator Ag2 for operation. When the selector contact arm dr has been stepped to its home or zero position, the pulse generator Tg is connected to a reset input of each of the counters. If the orderly operation of the apparatus is to be examined when no alarm has been given for some time, a key Ta can be pushed to open the reset circuit and prevent resetting of the counters. An attendant then recognizes whether the individual counters Z1-Zx reacted, or whether they remained in their zero positions, and thus a defect of the appartus can be determined.

It should be understood that the apparatus illustrated in FIG. 9 is a functional model which has been provided for simplicity and clarity. In order to keep the prescribed switching times, the electromechanical switching elements illustrated would be replaced by suitable electronic components.

The control sequence of FIG. 2 may be provided with the apparatus illustrated in FIG. 6 by replacing the cam N with the cam N' of FIG. 6A. The cam N' includes a portion N00' corresponding to the interval 00, a portion N03' corresponding to the interval 03, a portion N01' at the same level as the portion N00' and corresponding to the interval 01 which is a short initiate interval immediately prior to interrogation, and a portion N02' corresponding to the interrogation interval 02. As mentioned above, the process may utilize either of the sequences illustrated in FIGS. 1 and 2.

Although we have described our invention by reference to particular illustrative embodiments thereof, many changes and modifications may become apparent to those skilled in the art without departing from the spirit and scope of the invention. We therefore intend to include within the patent warranted hereon all such changes and modifications as may reasonably and properly be included within the scope of our contribution to the art.

We claim:

1. In a process of transmitting analog measuring value signals to a central control from a plurality of alarm circuits which are connected in the form of a chain in an alarm line and which are interrogated to produce analog measuring signals, and during which process a first voltage is applied to the alarm line to charge capacitors in the alarm circuits and then the alarm line is disconnected prior to an interrogation and fire detectors of the alarm circuits remain powered by their respective capacitors, and during which process a second voltage is applied to the alarm line so that a switching device in each alarm circuit operates to connect the following alarm circuit in the chain to the alarm line with a delay representing the measuring value of the connecting alarm circuit, and in which process the respective alarm circuit address is read from the number of preceding increases in alarm line current and the associated measuring value is derived from the length of the respective switching delay, the improvement therein comprising the steps of:

applying the first voltage to the alarm line as a full line voltage for a time sufficient to charge the capacitors and then removing the first voltage from the alarm line for an interval which is longer, at least by a multiple, than the sum of the charging and interrogation times permitting the capacitors to power the detectors; and applying a second voltage to the alarm line to cause the alarm circuits to cause the switching devices of each alarm circuit to sequentially connect the next following alarm circuit to the alarm line to place its analog measuring value on the alarm line.

2. The improved process of claim 1, wherein the intervals of applying voltages and removing voltages from the alarm line are selected such that voltage is applied for approximately 1/100 of the time that voltage is not applied to the alarm line.

3. The improved process of claim 1, wherein the application time of the first voltage is a charge interval, the time during which voltage is removed is a rest interval and the time of applications of the second voltage is an interrogation interval, and wherein the intervals are cyclically established.

4. The improved process of claim 3, wherein the cycles are sequenced in the order of:

rest interval;
interrogation interval; and
charge interval.

5. The improved process of claim 3, wherein the cycles are sequenced in the order of:

rest interval;
charge interval;
rest interval; and
interrogation interval.

6. The improved process of claim 3, wherein the cycle is adjusted by:

varying the lengths of the charge, rest and interrogation intervals.

* * * * *